US006354043B1

(12) United States Patent
Simon et al.

(10) Patent No.: US 6,354,043 B1
(45) Date of Patent: Mar. 12, 2002

(54) PRIVACY SCREEN AND METHOD FOR SYSTEMS FURNITURE AND THE LIKE

(75) Inventors: David E. Simon; Chris L. Domina, both of San Francisco, CA (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/473,642

(22) Filed: Dec. 28, 1999

(51) Int. Cl.[7] ..... E04B 1/346

(52) U.S. Cl. ..... 52/64; 160/87; 160/376; 160/370.23; 135/97; 126/450

(58) Field of Search ..... 160/179, 237, 160/327, 371, 352; 52/273, 222

(56) References Cited

U.S. PATENT DOCUMENTS 977,565 A * 12/1910 Smith
2,261,141 A 11/1941 Davis
2,261,142 A 11/1941 Davis
3,321,003 A 5/1967 Boerner
3,561,518 A * 2/1971 Johnson ..... 160/87
4,377,195 A 3/1983 Weil
4,404,962 A * 9/1983 Zinn et al. ..... 126/450
4,433,700 A * 2/1984 Dohet ..... 135/97
5,092,253 A 3/1992 Grund et al.
5,152,698 A 10/1992 Juhlin et al.
D354,818 S 1/1995 Johnson
5,531,258 A * 7/1996 Poulson et al. ..... 160/376
D385,044 S 10/1997 Johnson
5,724,778 A 3/1998 Cornell et al.
5,809,708 A 9/1998 Greer et al.
D399,063 S * 10/1998 Verbeck et al. ..... D6/332
5,899,025 A 5/1999 Casey et al.
5,943,834 A 8/1999 Jeffers et al.
5,950,371 A 9/1999 Rives et al.
6,135,193 A * 10/2000 Lloyd ..... 160/370.23

* cited by examiner

*Primary Examiner*—Carl D. Friedman
*Assistant Examiner*—Steve Varner
(74) *Attorney, Agent, or Firm*—Price, Heneveld, Cooper, DeWitt & Litton

(57) ABSTRACT

A privacy screen is configured for use with systems furniture and the like, such as post and beam arrangements that spatially partition an open office space into multiple workstations each having an interior with an opening into an adjacent space. The privacy screen is shaped to enclose a substantial portion of the opening of an associated workstation, and includes a generally flat lower portion, and a bowed upper portion that extends outwardly from the interior of the workstation to provide within the interior of the workstation a sense of spatial openness, as well as enhanced air and light influx, without detracting substantially from useable space on the opposite side of the privacy screen. The privacy screen may be constructed from a woven fabric with a single layer at the upper portion for greater visual porosity, and two layers at the lower portion for visual privacy.

64 Claims, 7 Drawing Sheets

PRIVACY SCREEN AND METHOD FOR SYSTEMS FURNITURE AND THE LIKE

BACKGROUND OF THE INVENTION

The present invention relates to systems furniture and the like, and in particular to a unique privacy screen and method therefor.

Open office plans are well known in the art, and generally comprise large, open floor spaces in a building that are furnished in a manner that is readily reconfigurable to accommodate the ever-changing needs of a specific user, as well as the divergent requirements of different tenants. One arrangement typically used for furnishing open plans includes movable partition panels that are detachably interconnected to partition off the open space into individual workstations or offices. Some such partition panels are configured to receive hangon furniture units, as well as worksurfaces, overhead cabinets, shelves, etc. Examples of such arrangements are disclosed in U.S. Pat. Nos. 5,899,035 and 5,943,834.

Another arrangement for dividing or partitioning open plans includes modular furniture arrangements in which a plurality of differently shaped, freestanding furniture units are interconnected in a side-by-side relationship, with upstanding privacy screens attached to at least some of the furniture units to create individual, distinct workstations or offices. Examples of such arrangements are disclosed in U.S. Pat. Nos. 5,152,698 and 5,092,253.

Yet another furnishing system for open office space is a post and beam arrangement, wherein a plurality of vertical posts are positioned at predetermined locations on the floor surface, with horizontal beams attached to the upper ends of the posts to create a three dimensional gridwork that spatially partitions the open plan into open workstations. Examples of such arrangements are disclosed in U.S. Pat. Nos. 5,724,778 and 5,809,708.

In each of the furniture arrangements noted above, which are generically referred to herein as "systems furniture", open spaces are often provided in the furniture layout, normally for ingress and egress from selected workstations or project areas. Such open spaces are particularly prevalent in the post and beam furniture systems. In any event, it is sometimes preferred to close off at least certain ones of such open spaces to provide additional privacy for a specified workstation or group work area. In many such situations, visual privacy is sufficient, and may in fact be preferred, due to the temporary nature of the furniture arrangement.

SUMMARY OF THE INVENTION

One aspect of the present invention is a privacy screen in combination with a post and beam furniture system of the type having a plurality of vertical posts with beams connected to upper ends of the posts to spatially partition an open office plan into multiple workstations each having an interior with an opening into an adjacent space. The privacy screen is shaped to enclose a substantial portion of the opening of an associated one of the workstations, and includes a generally flat lower portion and a bowed upper portion extending outwardly from the interior of the associated workstation to provide within the interior of the associated workstation a sense of spatial openness, as well as enhanced air and light influx, without detracting substantially from useable space on the opposite side of the privacy screen.

Another aspect of the present invention is a method for spatially partitioning open office space into discrete workstations, comprising the step of positioning a plurality of vertical posts in a predetermined pattern on the floor of the open office space, and connecting beams to upper ends of the posts to define a three dimensional open gridwork that spatially partitions the open space into a plurality of discrete workstations with open sides, and an access aisle extending along at least one of the open sides. The method also includes mounting at least one privacy screen on the open gridwork to enclose a selected one of the open sides of an associated one of the workstations, wherein the privacy screen has a generally flat lower portion and a bowed upper portion. The privacy screen is positioned on the open gridwork so that the bowed upper portion of the screen extends outwardly from the interior of the associated workstation and into the access aisle to provide within the interior of the associated workstation a sense of spatial openness, as well as enhanced air and light influx, without detracted substantially from useable space on the opposite side of the privacy screen at the access aisle.

Yet another aspect of the present invention is a privacy screen in combination with a furniture system of the type which partitions open plan space into workstations having an interior with an opening to an adjacent space. The privacy screen is shaped to enclose a substantial portion of the opening of an associated one of the workstations, and includes a generally flat lower portion and a bowed upper portion extending outwardly from the interior of the associated workstation to provide within the interior of the associated workstation a sense of spatial openness, as well as enhanced air and light influx, without detracting substantially from useable space on the opposite side of the privacy screen.

Yet another aspect of the present invention is a privacy screen for furniture systems of the type which partition open plan space into individual workstations having an interior with an opening to an adjacent space. The privacy screen includes a screen panel shaped to visually enclose a substantial portion of the opening of an associated one of the workstations, and includes a generally flat lower portion and a bowed upper portion that extends outwardly from the interior of the associated workstation to provide within the interior of the associated workstation a sense of spatial openness, as well as enhanced air and light influx, without detracting substantially from useable space on the opposite side of the screen panel.

Yet another aspect of the present invention is a privacy screen in combination with a post and beam furniture system of the type having a plurality of vertical posts with beams connected to upper ends of the posts to spatially partition an open office plan into multiple workstations each having an interior with an opening into an adjacent space. The privacy screen is shaped to enclose a substantial portion of the opening of an associated one of the workstations, and includes a perimeter frame having a panel of woven fabric material mounted thereon. The panel has a lower portion thereof extending from adjacent the floor to adjacent worksurface height, and is constructed from at least two layers of the woven fabric material, and has a density which renders the same generally opaque for enhanced visual privacy. The privacy screen also includes an upper portion which extends upwardly from adjacent worksurface height, and is constructed from a single layer of the woven fabric material, with density which renders the same generally translucent for enhanced light, air and visual porosity.

The principal objects of the present invention are to provide a privacy screen for systems furniture and the like that provides at least visual privacy, with a bowed upper portion which creates within the interior of the workstation a sense of spatial openness, as well as enhanced air and light influx, without detracting substantially from useable space on the opposite side of the privacy screen. The privacy screen preferably has a generally arcuate scoop shape at the top which functions like a light well to funnel overhead ambient light into the interior of the workstation. The privacy screen may be constructed from a sheet of woven fabric mounted over a perimeter frame so as to provide a very lightweight, inexpensive construction that permits substantial airflow for enhanced user comfort, and to accommodate the cooling of powered office equipment, such as computers and like in relatively small areas. Two layers of woven fabric material may be provided at the bottom portion of the screen to render the same generally opaque for enhanced visual privacy, with a single layer of the woven fabric at the upper portion of the screen to render the same translucent for enhanced light, air and visual porosity. The privacy screen may be easily and removably mounted on associated systems furniture to permit quick and easy reconfiguration of the area. The privacy screen is efficient in use, economical to manufacture, capable of a long operating life, and particularly well adapted for the proposed use.

These and other advantages of the invention will be further understood and appreciated by those skilled in the art by reference to the following written specification, claims and appended drawings.

DETAILED DESCRIPTION OF PREFERRED EMBODIMENT

Figure 1:
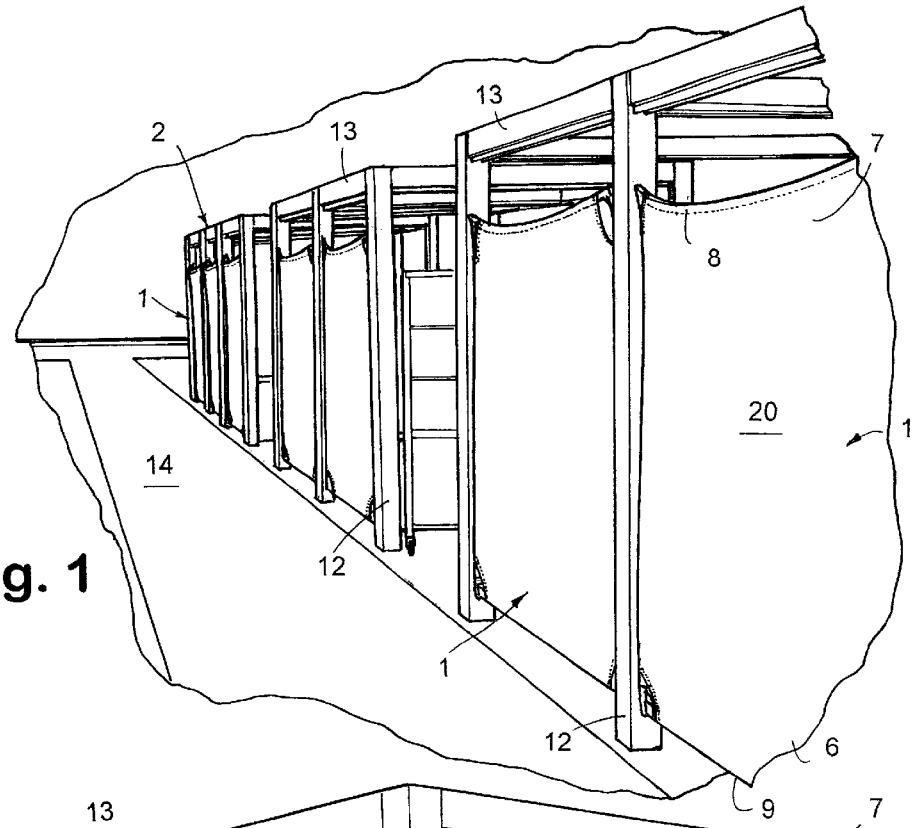
FIG. 1 is a perspective view of a plurality of privacy screens embodying the present invention, positioned along the aisle of an associated post and beam furniture system, and taken from the exterior sides of the associated workstations.
Figure 2:
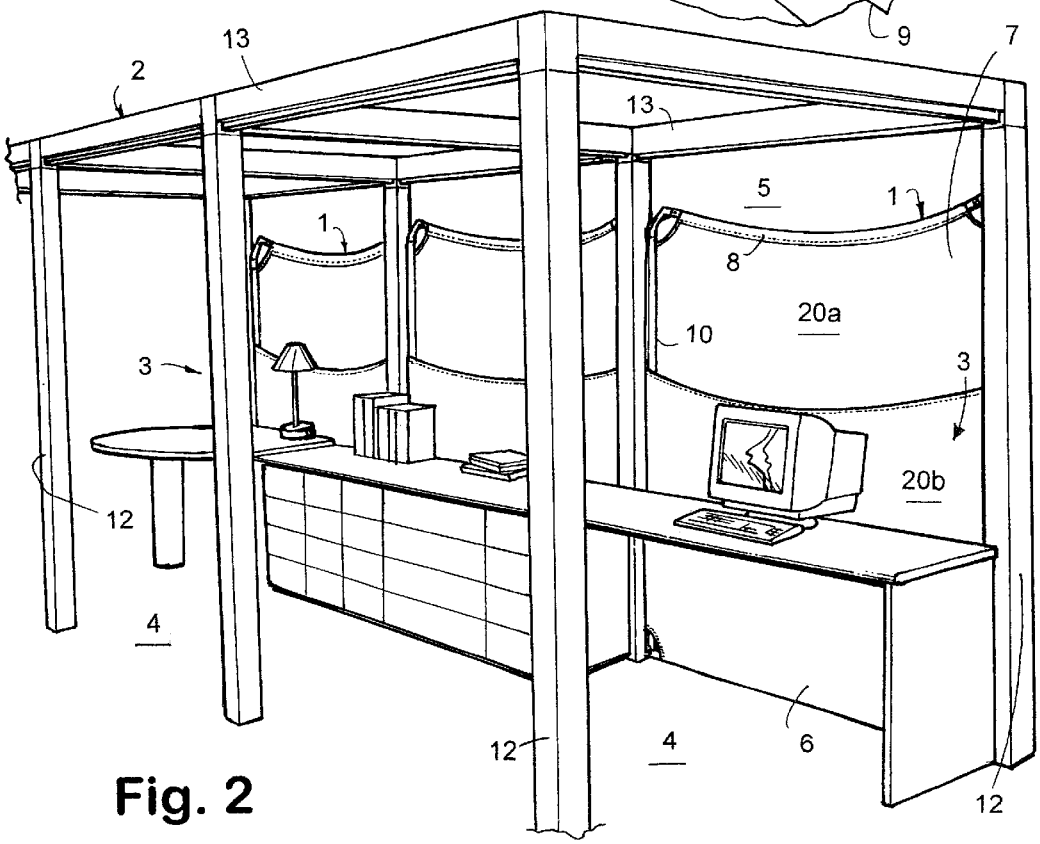
FIG. 2 is a perspective view of the privacy screens taken from the interior sides of the workstations.

For purposes of description herein, the terms "upper", "lower", "right", "left", "rear", "front", "vertical", "horizontal", and derivatives thereof shall relate to the invention as oriented in FIGS. 1 and 2. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a privacy screen embodying the present invention. Privacy screen 1 may be used in conjunction with a wide variety of different types of systems furniture, and is particularly adapted for use in conjunction with the illustrated post and beam furniture system 2, which spatially partitions an open office plan into multiple workstations 3, each having an interior 4 with an opening 5 into an adjacent space. Privacy screen 1 is shaped to enclose a substantial portion of the opening 5 of an associated workstation 3, and includes a generally flat lower portion 6 and a bowed or flared upper portion 7 that extends outwardly from the interior 4 of the workstation 3 to provide within the interior of the workstation 3 a sense of spatial openness, as well as enhanced air and light influx, without detracting substantially from the useable space on the opposite side of privacy screen 1.

Figure 25:
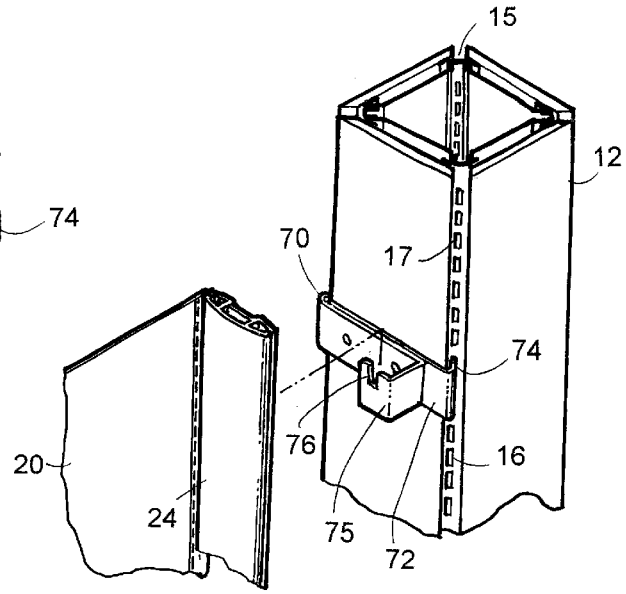
FIG. 25 is a fragmentary, perspective view of the privacy screen being mounted on a bracket attached to a furniture post.
Figure 26:
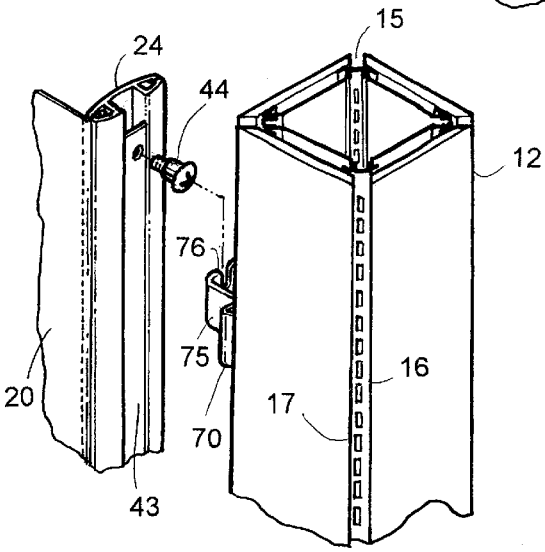
FIG. 26 is a fragmentary, perspective view of the privacy screen being attached to the mounting bracket on an associated furniture post.
Figure 27:
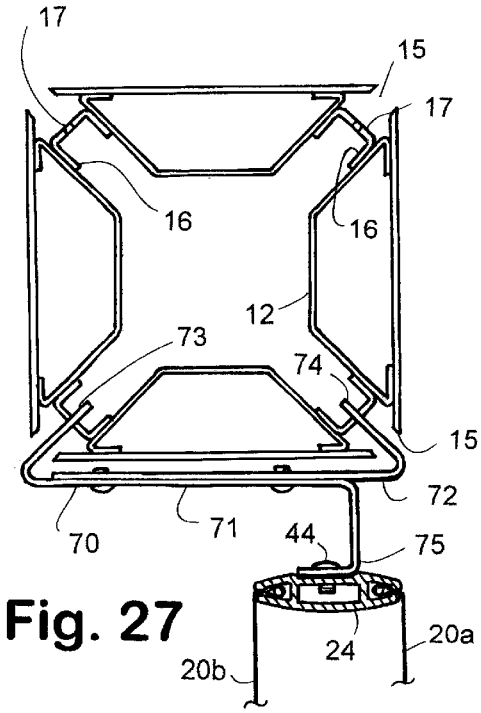
FIG. 27 is a fragmentary, horizontal cross-sectional view, showing the privacy screen attached to a mounting bracket on an associated furniture post.

The illustrated post and beam furniture system 2 is similar to that disclosed in Assignee's related U.S. Pat. Nos. 5,899,025 and 5,950,371, which are hereby incorporated herein by reference, and generally comprises a plurality of posts 12 with beams 13 connected to the upper ends of posts 12 to define a three dimensional open gridwork which spatially partitions the open office space into a plurality of workstations 3. In the example illustrated in FIGS. 1 and 2, a series of workstations 3 are located immediately adjacent to an access aisle 14. As best illustrated in FIGS. 25–27, each of the posts 12 has a substantially square lateral cross-sectional shape, with open comers 15. Hanger strips 16 are positioned behind each of the open comers 15, and include a series of vertically spaced apart hanger slots 17 to support various accessories, as explained in greater detail hereinafter.

Figure 3:
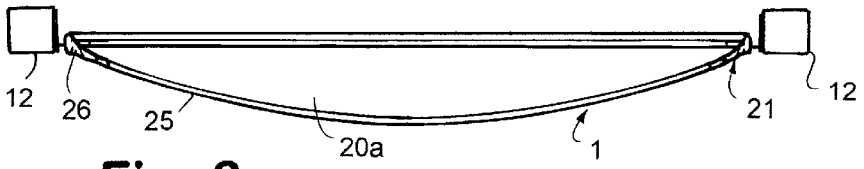
FIG. 3 is a top plan view of a privacy screen, shown mounted on an associated post and beam furniture system.
Figure 4:
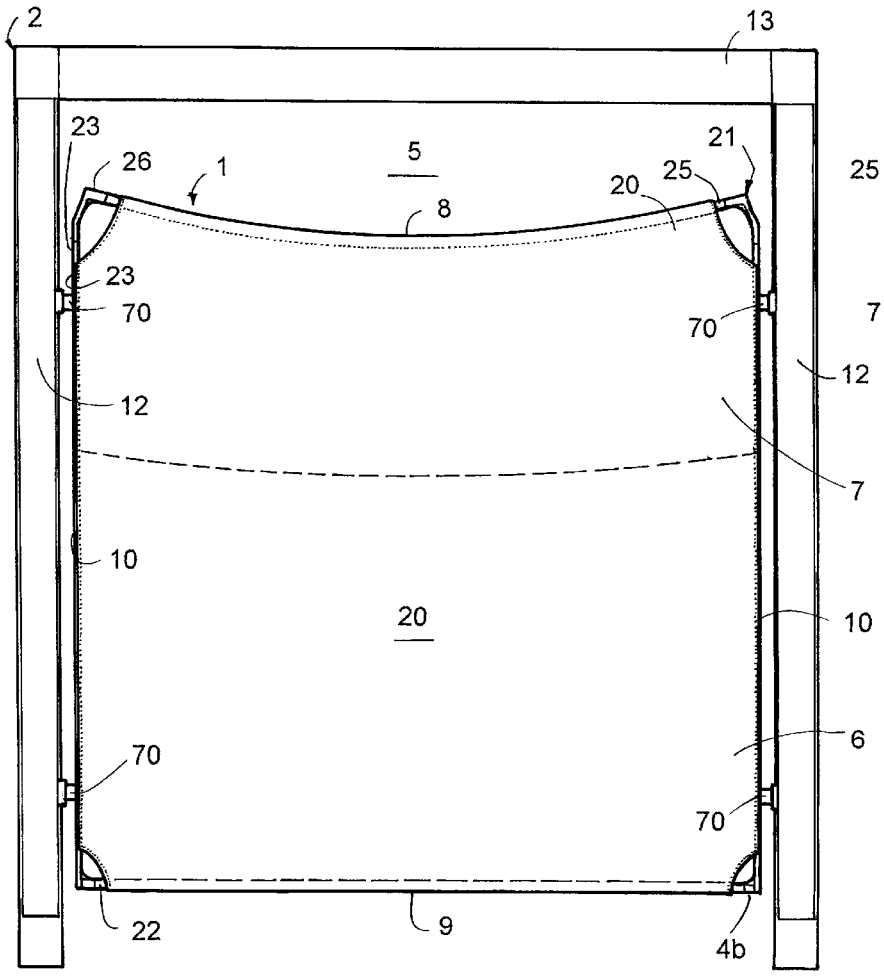
FIG. 4 is a front elevational view of the privacy screen, shown mounted on the associated post and beam furniture system.
Figure 5:
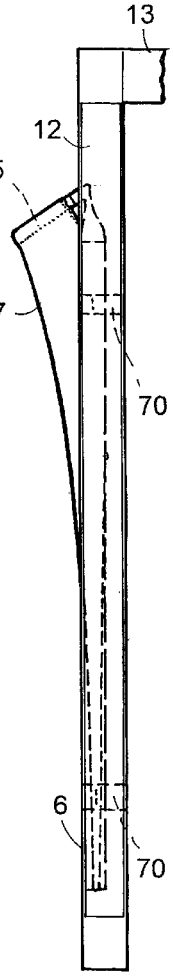
FIG. 5 is a side elevational view of the privacy screen, shown mounted on the associated post and beam furniture system.
Figure 13:
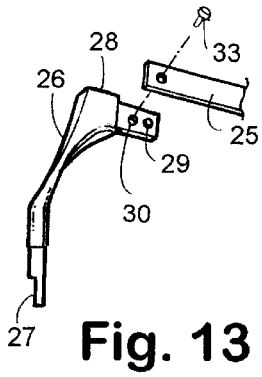
FIG. 13 is an exploded, fragmentary, perspective view of the upper connector portion of the perimeter frame, taken from a rear side thereof.
Figure 12:
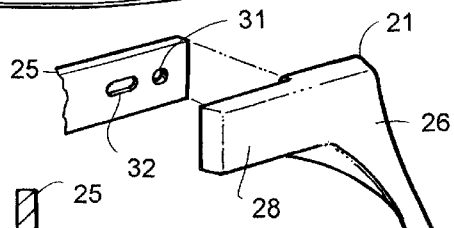
FIG. 12 is an exploded, fragmentary, perspective view of an upper comer connection portion of the perimeter frame, taken from a forward side thereof.
Figure 10:
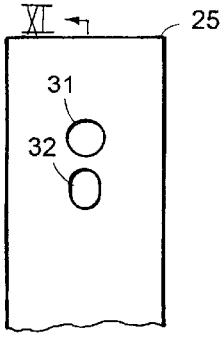
FIG. 10 is a front elevational view of the upper member of the perimeter frame.
Figure 10:
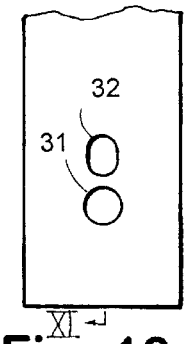
Figure 11:
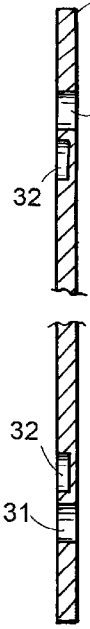
FIG. 11 is a longitudinal cross-sectional view of the upper member of the perimeter frame, taken along the line XI—XI, FIG. 10.

With reference to FIGS. 3–5, the upper portion 7 of privacy screen 1 has a generally arcuate scoop shape which tapers into the generally flat lower portion 6 of privacy screen 1. In the illustrated example, privacy screen 1 has a generally square front elevational shape, defining a top 8, a bottom 9 and opposite sides 10, and is constructed from a sheet or panel 20 of flexible fabric that is mounted on a rigid perimeter frame 21. As best illustrated in FIGS. 8–14, perimeter frame 21 includes a straight lower member 22 extending horizontally across opening 5 adjacent a lower portion thereof, a pair of generally straight side members 23 and 24 extending vertically along opposite sides of opening 5, and a bowed upper member 25 extending horizontally across opening 5 adjacent the upper portion thereof. Upper member 25 is rigidly attached to the side members 23 and 24 by a pair of upper corner connectors 26, each of which includes a lower tongue 27 that is closely received within the interior of hollow side members 23 and 24, and an angled upper mounting plate 28 having a locator boss 29 (FIG. 13) on the interior side thereof, and a threaded attachment aperture 30. The illustrated upper frame member 25 is a flexibly resilient member having a normally straight shape, in the nature of a leaf spring, that is elastically deformed into the illustrated outwardly bowed configuration during assembly, as described below. As best illustrated in FIGS. 10 and 11, in the present example, upper frame member 25 is in the shape of a bar having a substantially rectangular lateral cross-sectional shape, and is constructed from a spring steel, or similar material. The outer ends of upper frame member 25 include a through-aperture 31 and a locator recess 32. As shown in FIGS. 12 and 13, during assembly, upper frame member 25 is bowed or elastically deformed outwardly to its predetermined shape as determined by upper corner connectors 26, and the locator boss 29 on upper corner connectors 26 is positioned within the locator recess 32 on upper frame member 25, which automatically aligns aperture 31 with threaded aperture 30 to receive a fastening screw 33 therethrough to securely attach upper frame member 25 at its outer ends to the opposite upper corner connectors 26, and remaining portions of perimeter frame 21.

Figure 15:
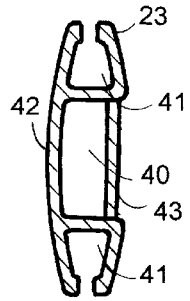
FIG. 15 is an enlarged lateral cross section of the side member of the perimeter frame, taken along the line XV—XV, FIG. 14.
Figure 16:
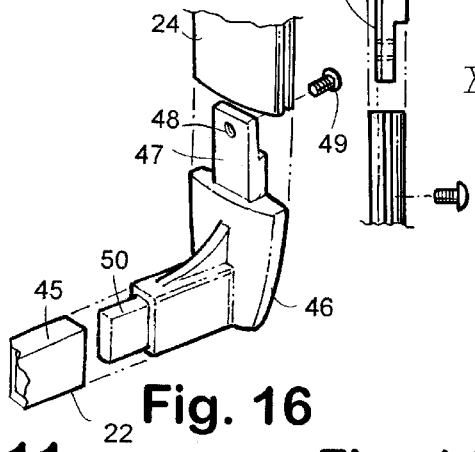
FIG. 16 is an exploded, fragmentary, perspective view of a lower comer portion of the perimeter frame.
Figure 14:
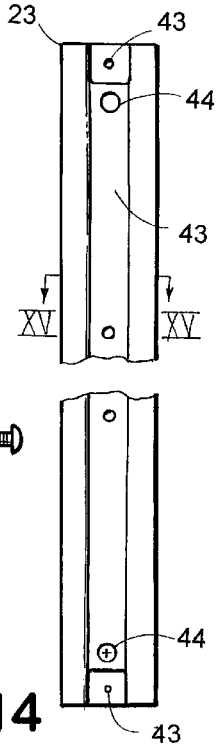
FIG. 14 is a fragmentary side elevational view of a side member portion of the perimeter frame.

The illustrated side frame members 23 and 24 are substantially identical, and as best illustrated in FIGS. 14–16, each includes a hollow center portion 40 with open channels 41 at opposite sides thereof. Each of the side frame members 23 and 24 has an arcuate inner surface 42 and a stepped outer surface 43. As best illustrated in FIG. 14, the opposite ends of side frame members 23 and 24 include fastener apertures 43, and laterally projecting hanger studs 44.

The illustrated lower frame member 22 (FIG. 16) comprises a rigid rectangular bar 45 having a hollow interior. Lower corner connectors 46 are provided to interconnect the lower ends of side frame members 23 and 24 with the opposite ends of lower frame member 22. Each lower corner connector 46 includes an upwardly extending tongue 47 that is closely received within the interior 40 of each of the frame side members 23 and 24, with a lateral aperture 48 in which a mating fastener 49 is received. A second tongue 50 extends laterally from the lower portion of lower comer connector 46, and is shaped to be closely received within the interior of frame bar 45.

During assembly of perimeter frame 21, lower member 22 is interconnected with the side members 23 and 24 by lower connectors 46 and associated fasteners, as explained above. Upper comer connectors 26 are mounted in the upper ends of side frame members 23 and 24, and retained in place by fasteners 33. Upper frame member 25 must then be elastically deflected into the outwardly bowed configuration prior to attachment to upper comer connectors 26.

Figure 17:
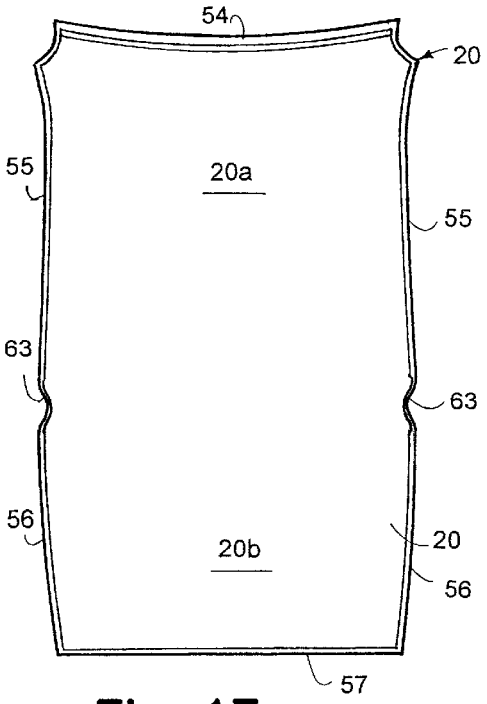
FIG. 17 is a rear elevational, developed view of a fabric panel portion of the privacy screen.
Figure 18:
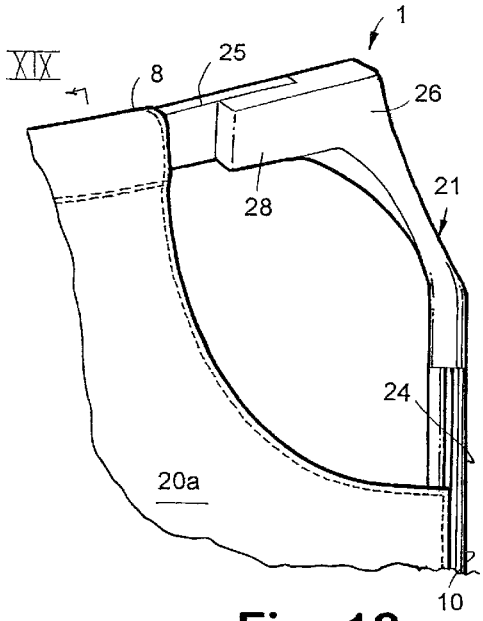
FIG. 18 is a fragmentary, perspective view of an upper portion of the privacy screen, showing attachment of the fabric panel to the perimeter frame.
Figure 19:
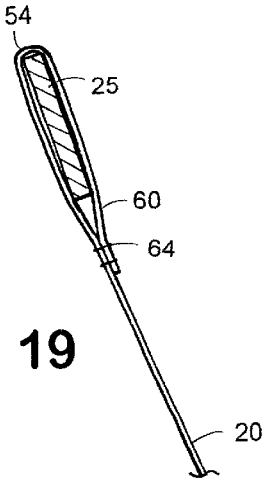
FIG. 19 is a fragmentary, vertical cross-sectional view of the privacy screen, taken along the line XIX—XIX, FIG. 18.

The illustrated fabric panel 20 (FIGS. 17–21) is constructed from a single sheet of woven stretch fabric, such as lycra, or the like, and has a developed shape, prior to assembly, as illustrated in FIG. 17, comprising a curved or convex upper edge 54, generally straight upper side edges 55, and inwardly tapered lower side edges 56, which as discussed in greater detail below, are disposed at the lower portion of the assembled privacy screen 1. The bottom edge 57 of the preinstalled fabric panel 20 is generally straight.

Figure 20:
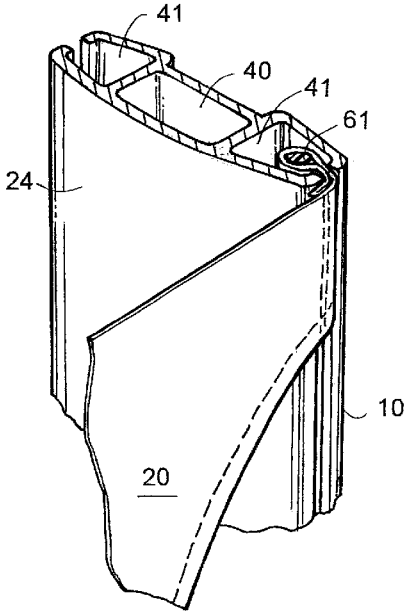
FIG. 20 is a fragmentary, perspective view of the side member of the perimeter frame, showing attachment of the fabric panel thereto.
Figure 23:
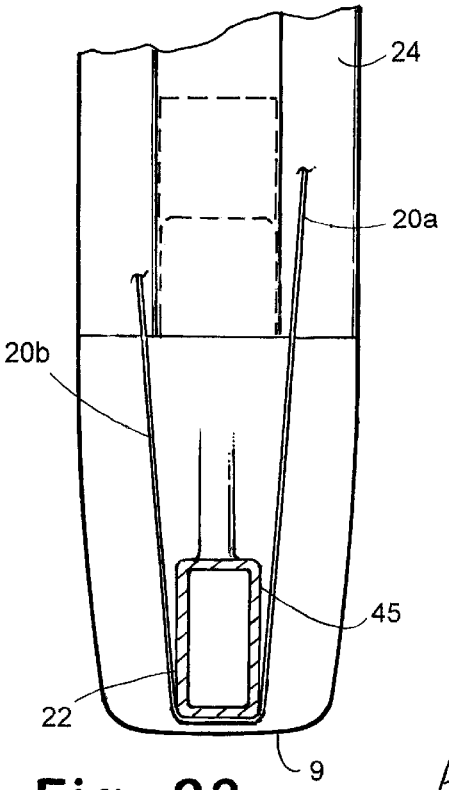
FIG. 23 is a fragmentary, vertical cross-sectional view of the privacy screen, taken along the line XXIII, FIG. 21.
Figure 22:
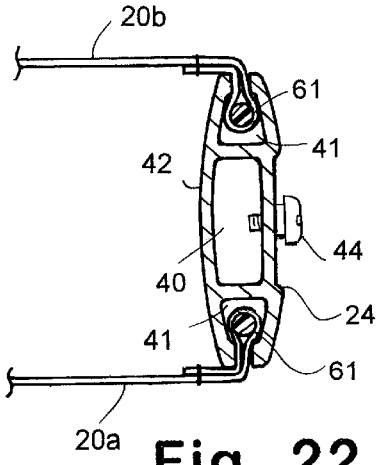
FIG. 22 is a fragmentary, enlarged, horizontal cross-sectional view of the privacy screen, taken along the line XXII—XXII, FIG. 21.
Figure 24:
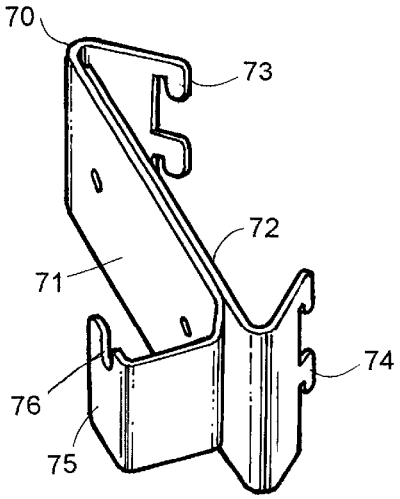
FIG. 24 is a perspective view of a hanger bracket for attaching the privacy screen to an associated furniture post.

Fabric panel 20 is attached to perimeter frame 21 in the following manner. A sewn pocket 60 (FIG. 19) is formed along the upper edge 54 of fabric panel 20 by folding the outer edge downwardly and sewing a seam 64 through the overlapped layers of fabric in the fashion illustrated in FIG. 19. Sewn pocket 60 has an interior shape configured to receive upper frame member 25 therein. As illustrated in FIGS. 20 and 22, four separate rods 61 are sewn into seams formed along each of the side edges 55 and 56 of fabric panel 20. Rods 61 are shaped to be inserted into and closely received within the open sided channels 41 of side frame members 23 and 24. As best illustrated in FIG. 17, the rods 61 on both sides of fabric panel 20 are separated by a gap 63 for purposes of forming the bottom 9 of privacy screen 1, as described below.

Figure 6:
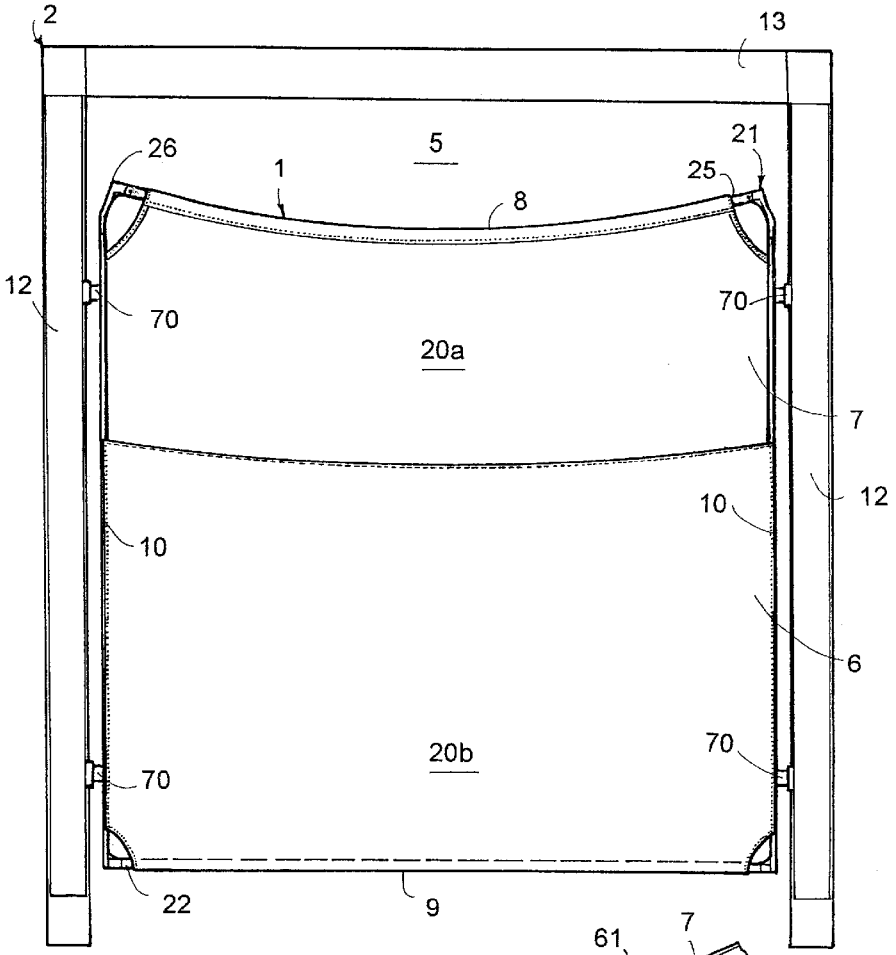
FIG. 6 is a rear elevational view of the privacy screen, shown mounted on the associated post and beam furniture system.
Figure 7:
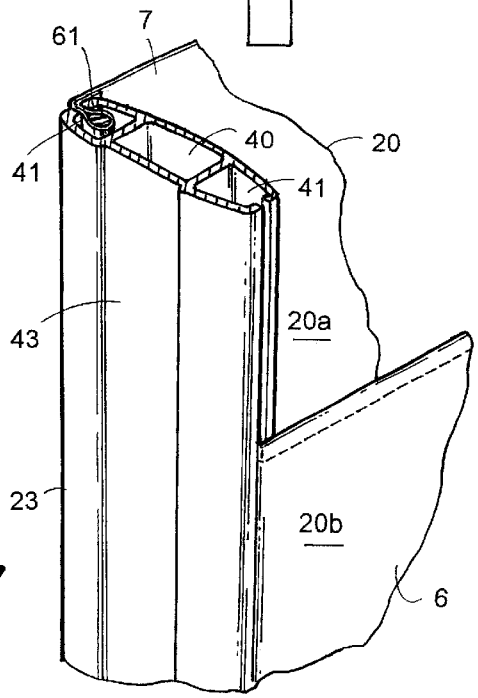
FIG. 7 is an enlarged, fragmentary, perspective view of the privacy screen taken from the interior side thereof, and showing overlapping layers of fabric material.
Figure 8:
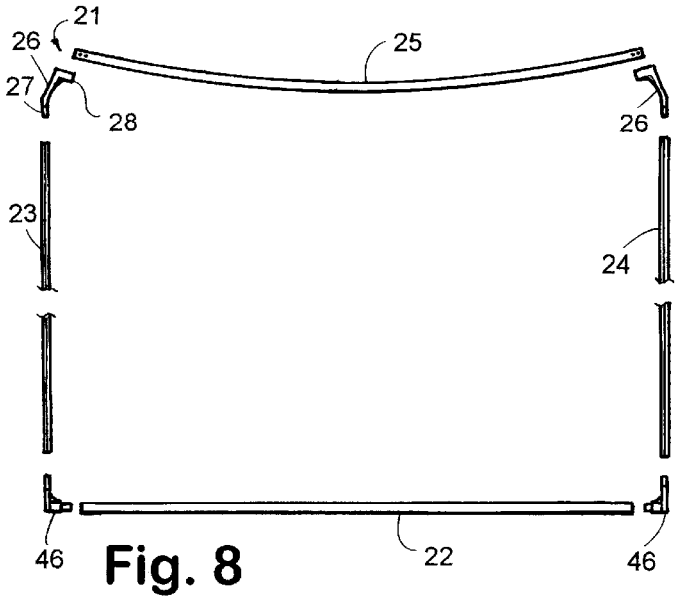
FIG. 8 is an exploded, fragmentary front elevational view of a perimeter frame portion of the privacy screen.
Figure 9:
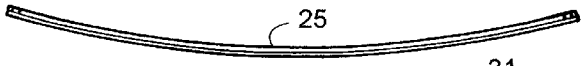
FIG. 9 is a top plan view of an upper member of the perimeter frame.
Figure 21:
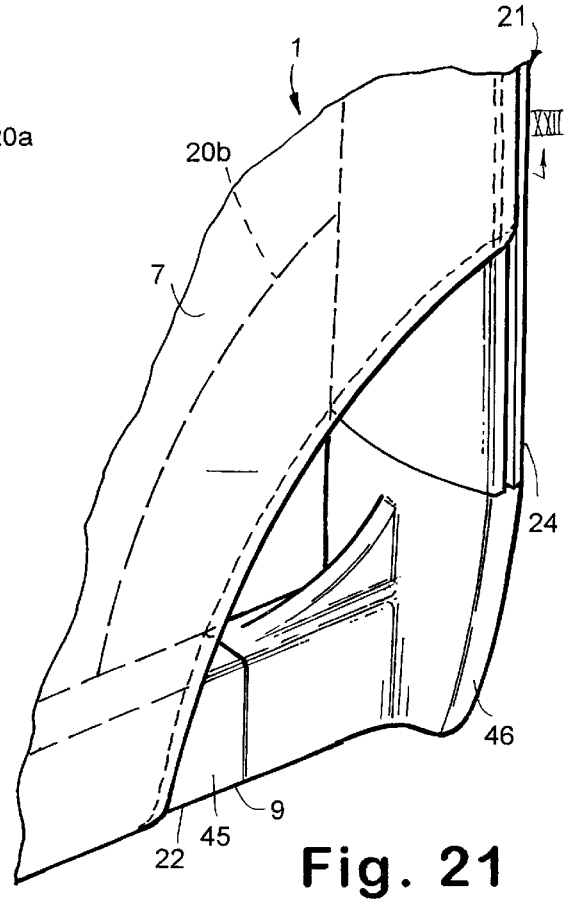
FIG. 21 is a fragmentary, perspective view of the lower corner of the privacy screen, showing attachment of the fabric panel to the perimeter frame.

The illustrated privacy screen 1 is constructed from a single fabric panel 20, which extends along the forward side of perimeter frame 21 to define front panel portion **20*a*, is folded over lower frame member 22 at the bottom 9 of privacy screen 1, as shown in FIG. 21, and is then attached to the rear side of perimeter frame 21 to extend up to a position somewhat above worksurface height, but below the top edge 54 of fabric panel 20 to define rear panel portion 20*b*. Hence, as shown in FIGS. 6 and 7, the lower portion 6 of privacy screen 1 is constructed from two spaced apart layers of fabric, and has a density which renders the same generally opaque for enhanced visual privacy, and the upper portion 7 of privacy screen 1 is constructed from a single layer of the woven fabric, and has a density which renders the same generally translucent for enhanced light, air and visual porosity. Hence, when a worker within an associated workstation 3** is in a seated position, maximum privacy is achieved to support high concentration work, yet when the worker stands, minimum privacy is achieved to support interactive work.

In one working embodiment of the present invention, post and beam furniture system 2 has posts 12 which position the tops of beams 13 approximately 90 inches above the surface of the floor, with posts 12 being spaced laterally apart around 70 inches. The corresponding privacy screen 1 has an overall height between top 8 and bottom 9 of around 68–70 inches, an overall width between sides 10 of around 68 inches, with the bottom 9 of privacy screen 1 positioned around 7–8 inches above the floor surface. However, it is to be understood that the vertical position of privacy screen 1 within opening 5 can be easily adjusted by simply relocating hanger brackets 70 along furniture posts 12. The subject exemplary privacy screen 1 has the flat rear sheet 20*b* of fabric panel 20 extending to a height of around 50 inches from the floor surface (i.e., around 20 inches above typical worksurface height), and as best illustrated in FIG. 6, the uppermost edge 57 of rear sheet 20*a* is concave or arcuate in the fully assembled condition. The size of the associated fabric panel 20 in the developed view shown in FIG. 17 is around 60 inches wide and 99 inches long, with the fabric being stretched over perimeter frame 21 in both the vertical and horizontal directions, so as to create a smooth contoured appearance. In the noted working embodiment, the stretch fabric is selected such that it is generally opaque in the unstretched condition, and generally translucent in the final stretched condition. The bowed upper portion 7 of the subject exemplary privacy screen is at an angle of approximately 15–30 degrees from the vertical, as viewed in FIG. 5, such that it projects outwardly at its uppermost edge around 6–8 inches at the center, and extends along an arc, as viewed in FIG. 3, having a diameter of around 75–85 inches. The top 8 of the subject privacy screen 1 is also bowed downwardly, such that the same has a concave front elevational shape, as viewed in FIG. 4, wherein the center portion of top 8 is around 4–5 inches lower than the outer edges of top 8. The funnel shape of the bowed upper portion 7 of the subject privacy screen 1 tapers gently into the flat lower portion 6 to a line around 25–26 inches from the bottom 9 of privacy screen 1. The angle of bowed upper portion 7 can be varied to accommodate a specific application, and is preferably selected of an angle sufficiently great to create the noted light funnel or well, yet sufficiently small as to avoid drooping and/or substantial encroachment into adjacent useable space.

The noted working embodiment of the present invention is assembled as follows. The rods 61 along the side edges 55 and 56 of fabric panel 20 are inserted into channels 41 of side frame members 23 and 24 from the lower ends thereof. The opposite ends of fabric panel 20 are tensed as the upper ends of rods 61 reach their assembled positions within perimeter frame 21. As shown in FIGS. 21 and 22, fabric panel 20 simply folds over the lower frame member 22 and extends along both sides of the subject privacy screen 1, such that no sewn pocket is required at screen bottom 9, yet fabric panel 20 is securely captured on perimeter frame 21. Upper frame member 25 is then inserted into pocket 60 along the upper edge 54 of fabric panel 20, flexed outwardly and downwardly into its predetermined bowed shape, and attached to the upper corner connectors 26 as described above, which further stretches fabric panel 20 in a vertical direction.

With reference to FIGS. 24–27, hanger brackets 70 are provided to detachably mount privacy screen 1 on post and beam furniture system 2. The illustrated hanger bracket 70 comprises a pair of interconnected plates 71 and 72, having at outer ends thereof inwardly turned hooks 73 and 74 which are configured to be received within an associated pair of mounting slots 17 on furniture posts 12. Exterior plate 71 includes an outwardly extending cradle 75 with an upwardly opening notch 76 shaped to closely receive therein an adjacent hanger stud 44 on side frame members 23 and 24.

In the example illustrated in FIGS. 3–5, four hanger brackets 70 are used to detachably mount privacy screen 1 to post and beam furniture system 2. A pair of hanger brackets 70 are attached to each of the opposed furniture posts 12 at locations adjacent the upper and lower portions of privacy screen 1, respectively. After hanger brackets 70 have been mounted to their associated furniture posts by insertion of hooks 73 and 74 into aligned hanger slots 17, privacy screen 1 is then detachably connected to the four hangers 70 by positioning each of the hanger studs 44 in the slots 76 of hanger brackets 70.

In the examples illustrated in FIGS. 1 and 2, post and beam furniture system 2 is positioned adjacent access aisle 14, and in each of the workstations 3 formed by post and beam furniture system 2, the openings 5 positioned adjacent access aisle 14 are provided with a privacy screen 1 to provide visual privacy from the interior of the workstations 3, as illustrated in FIG. 2. Each of the privacy screens 1 is positioned on the open gridwork of post and beam furniture system 2 so that the bowed upper portion 7 of each screen 1 extends outwardly from the interior 4 of the associated workstation 3 into the access aisles 14. As a consequence, the interior 4 of each of the related workstations 3 has a sense of spatial openness as well as enhanced air and light influx, without detracting substantially from useable space on the opposite side of the privacy screen along the access aisle 14. Furthermore, the scooped shape of the upper portion 7 of each privacy screen 1, in conjunction with the reflective nature of the material, funnels overhead ambient light into the interior of each of the workstations 3.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. In a post and beam furniture system of the type having a plurality of vertical posts with beams connected to upper ends of said posts to spatially partition an open office plan into multiple workstations each having an interior with an opening into an adjacent space, the improvement comprising:

at least one privacy screen shaped to enclose a substantial portion of the opening of an associated one of said workstations, and having a front surface thereof with a generally flat lower portion and a bowed upper portion extending outwardly from the interior of said one workstation to provide within the interior of said one workstation a sense of spatial openness as well as enhanced air and light influx, without detracting substantially from useable space on the opposite side of said privacy screen.

2. A furniture system as set forth in claim 1, wherein:

said upper portion of said privacy screen has a generally arcuate scoop shape which tapers to the generally flat lower portion of said privacy screen.

3. A furniture system as set forth in claim 2, wherein:

said privacy screen is constructed from a fabric sheet.

4. A furniture system as set forth in claim 3, wherein:

said privacy screen includes a perimeter frame on which said fabric sheet is mounted.

5. A furniture system as set forth in claim 4, wherein:
said fabric sheet has a light reflective interior surface such that said upper portion of said privacy screen funnels overhead ambient light into the interior of said one workstation.

6. A furniture system as set forth in claim 5, wherein:
said privacy screen has a bottom thereof spaced apart from the floor surface of the open office plan for enhanced air circulation.

7. A furniture system as set forth in claim 6, wherein:
said perimeter frame includes a generally straight lower member extending horizontally across said opening adjacent a lower portion thereof, a pair of generally straight side members extending vertically along opposite sides of said opening, and a bowed upper member extending horizontally across said opening adjacent an upper portion thereof.

8. A furniture system as set forth in claim 7, wherein:
said fabric sheet comprises a woven stretch fabric having a perimeter thereof attached to said perimeter frame in a tensed condition to conform to the shape of said perimeter frame, and form said generally arcuate scoop shape which tapers to said generally flat lower portion of said privacy screen.

9. A furniture system as set forth in claim 8, wherein:
said bowed upper member of said perimeter frame comprises a flexibly resilient member having a normally straight shape that is elastically deformed into an outwardly bowed shape during assembly.

10. A furniture system as set forth in claim 9, wherein:
said upper portion of said privacy screen is constructed from a single layer of said woven stretch fabric, and has a density which renders the same generally translucent for enhanced light, air and visual porosity.

11. A furniture system as set forth in claim 10, wherein:
said lower portion of said privacy screen is constructed from at least two layers of said woven stretch fabric, and has a density which renders the same generally opaque for enhanced visual privacy.

12. A furniture system as set forth in claim 11, wherein:
said posts include mounting slots extending vertically along at least one side thereof; and including
hang-on brackets detachably mounted in said slots, and connected with said perimeter frame to removably mount said privacy screen over said opening.

13. A furniture system as set forth in claim 12, wherein:
said fabric sheet includes an upper pocket in which said upper member of said perimeter frame is received.

14. A furniture system as set forth in claim 13, wherein:
said fabric sheet is constructed from a single sheet that is folded over said lower member of said perimeter frame to define said at least two layers at the lower portion of said privacy screen.

15. A furniture system as set forth in claim 14, wherein:
said fabric sheet includes sewn-in connectors extending along the opposite sides thereof; and
said side members of said perimeter frame include a pair of channels on opposite sides thereof in which said sewn-in connectors are inserted and captured.

16. A furniture system as set forth in claim 15, wherein:
said upper member of said perimeter frame is bowed both outwardly and downwardly such that said privacy screen has a top with a concave front elevational shape.

17. A furniture system as set forth in claim 1, wherein:
said privacy screen includes a perimeter frame having a generally straight lower member extending horizontally across said opening adjacent a lower portion thereof, a pair of generally straight side members extending vertically along opposite sides of said opening, and a bowed upper member extending horizontally across said opening adjacent an upper portion thereof.

18. A furniture system as set forth in claim 17, wherein:
said upper member of said perimeter frame is bowed both outwardly and downwardly such that said privacy screen has a top with a concave front elevational shape.

19. A furniture system as set forth in claim 18, wherein:
said bowed upper member of said perimeter frame comprises a flexibly resilient member having a normally straight shape that is elastically deformed into an outwardly bowed shape during assembly.

20. A furniture system as set forth in claim 1, wherein:
said privacy screen is constructed from a fabric sheet.

21. A furniture system as set forth in claim 20, wherein:
said upper portion of said privacy screen is constructed from a single layer of woven stretch fabric, and has a density which renders the same generally translucent for enhanced light, air and visual porosity; and
said lower portion of said privacy screen is constructed from at least two layers of woven stretch fabric, and has a density which renders the same generally opaque for enhanced visual privacy.

22. A furniture system as set forth in claim 20, wherein:
said fabric sheet has a light reflective interior surface such that said upper portion of said privacy screen funnels overhead ambient light into the interior of said one workstation.

23. A furniture system as set forth in claim 1, wherein:
said posts include mounting slots extending vertically along at least one side thereof; and including
hang-on brackets detachably mounted in said slots, and connected with said privacy screen to removably mount said privacy screen over said opening.

24. A furniture system as set forth in claim 1, wherein:
said privacy screen has a bottom thereof spaced apart from the floor surface of the open office plan for enhanced air circulation.

25. A method for spatially partitioning open office space into discrete workstations, comprising:
positioning a plurality of vertical posts in a predetermined pattern on the floor of the open office space;
connecting beams to upper ends of the posts to define a three dimensional open gridwork which spatially partitions the open office space into a plurality of discrete workstations with open sides, and an access aisle extending along at least one of the open sides;
mounting at least one privacy screen an exterior surface on the open gridwork to enclose a selected one of the open sides of an associated one of the workstations, wherein the privacy screen has a generally flat lower portion and a bowed upper portion; and
positioning the privacy screen on the open gridwork so that the bowed upper portion of the screen extends outwardly from the interior of the one workstation and into the access aisle to provide within the interior of the one workstation a sense of spatial openness as well as enhanced air and light influx, without detracting substantially from useable space on the opposite side of the privacy screen at the access aisle.

26. A method as set forth in claim 25, including:
forming the upper portion of the privacy screen into a generally arcuate scoop shape which bows both outwardly and downwardly at the top, and tapers to the generally flat lower portion of the privacy screen.

27. A method as set forth in claim 26, including:

forming the privacy screen from a perimeter frame and mounting a fabric sheet on the perimeter frame.

28. A method as set forth in claim 27, wherein:

said privacy screen forming step includes providing a woven stretch fabric and attaching the perimeter of the fabric to the perimeter frame in a tensed condition to conform to the shape of the perimeter frame, and form the generally arcuate scoop shape which tapers to the generally flat lower portion of the privacy screen.

29. A method as set forth in claim 28, wherein:

said privacy screen forming step includes constructing the upper portion of the privacy screen from a single layer of the woven stretch fabric, and providing the same with a density which renders the upper portion generally translucent for enhanced light, air and visual porosity.

30. A method as set forth in claim 29, wherein:

said privacy screen forming step includes constructing the lower portion of the privacy screen from at least two layers of the woven stretch fabric, and providing the same with a density which renders the lower portion generally opaque for enhanced visual privacy.

31. A method as set forth in claim 30, including:

providing the fabric sheet with a light reflective interior surface such that the upper portion of the privacy screen funnels overhead ambient light into the interior of the one workstation;

positioning a bottom of the privacy screen a spaced apart distance from the floor surface of the open office plan for enhanced air circulation; and constructing the bowed upper member of the perimeter frame from a flexibly resilient member having a normally straight shape that is elastically deformed into an outwardly bowed shape during assembly.

32. In a furniture system for partitioning open plan space into workstations of the type having an interior with an opening to an adjacent space, the improvement comprising:

a privacy screen shaped to enclose a substantial portion of the opening of an associated one of said workstations, and having a front surface thereof with a generally flat lower portion and a bowed upper portion extending outwardly from the interior of said one workstation to provide within the interior of said one workstation a sense of spatial openness as well as enhanced air and light influx, without detracting substantially from useable space on the opposite side of said privacy screen.

33. A furniture system as set forth in claim 32, wherein:

said upper portion of said privacy screen has a generally arcuate scoop shape which tapers to the generally flat lower portion of said privacy screen.

34. A furniture system as set forth in claim 33, wherein:

said privacy screen is constructed from a fabric sheet.

35. A furniture system as set forth in claim 34, wherein:

said privacy screen includes a perimeter frame on which said fabric sheet is mounted.

36. A furniture system as set forth in claim 35, wherein:

said fabric sheet has a light reflective interior surface such that said upper portion of said privacy screen funnels overhead ambient light into the interior of said one workstation.

37. A furniture system as set forth in claim 36, wherein:

said privacy screen has a bottom thereof spaced apart from the floor surface of the open office plan for enhanced air circulation.

38. A furniture system as set forth in claim 37, wherein:

said fabric sheet comprises a woven stretch fabric having a perimeter thereof attached to said perimeter frame in a tensed condition to conform to the shape of said perimeter frame, and form said generally arcuate scoop shape which tapers to said generally flat lower portion of said privacy screen.

39. A furniture system as set forth in claim 38, wherein:

said bowed upper member of said perimeter frame comprises a flexibly resilient member having a normally straight shape that is elastically deformed into an outwardly bowed shape during assembly.

40. A furniture system as set forth in claim 39, wherein:

said upper portion of said privacy screen is constructed from a single layer of said woven stretch fabric, and has a density which renders the same generally translucent for enhanced light, air and visual porosity.

41. A furniture system as set forth in claim 40, wherein:

said lower portion of said privacy screen is constructed from at least two layers of said woven stretch fabric, and has a density which renders the same generally opaque for enhanced visual privacy.

42. A furniture system as set forth in claim 41, wherein:

said upper member of said perimeter frame is bowed both outwardly and downwardly such that said privacy screen has a top with a concave front elevational shape.

43. A privacy screen for furniture systems of the type which partition open plan space into individual workstations having an interior with an opening to an adjacent space, comprising:

a screen panel shaped to visually enclose a substantial portion of the opening of an associated one of the workstations, and having a front surface thereof with a generally flat lower portion and a bowed upper portion extending outwardly from the interior of the one workstation to provide within the interior of the workstation a sense of spatial openness as well as enhanced air and light influx, without detracting substantially from useable space on the opposite side of said screen panel.

44. A privacy screen as set forth in claim 43, wherein:

said upper portion of said privacy screen has a generally arcuate scoop shape which tapers to the generally flat lower portion of said privacy screen.

45. A privacy screen as set forth in claim 44, wherein:

said privacy screen is constructed from a fabric sheet.

46. A privacy screen as set forth in claim 45, wherein:

said privacy screen includes a perimeter frame on which said fabric sheet is mounted.

47. A privacy screen as set forth in claim 46, wherein:

said fabric sheet has a light reflective interior surface such that said upper portion of said privacy screen funnels overhead ambient light into the interior of said one workstation.

48. A privacy screen as set forth in claim 47, wherein:

said privacy screen has a bottom thereof spaced apart from the floor surface of the open office plan for enhanced air circulation.

49. A privacy screen as set forth in claim 48, wherein:

said perimeter frame includes a generally straight lower member extending horizontally across the opening adjacent a lower portion thereof, a pair of generally straight side members extending vertically along opposite sides of the opening, and a bowed upper member extending horizontally across the opening adjacent an upper portion thereof.

50. A privacy screen as set forth in claim 49, wherein:

said fabric sheet comprises a woven stretch fabric having a perimeter thereof attached to said perimeter frame in a tensed condition to conform to the shape of said perimeter frame, and form said generally arcuate scoop shape which tapers to said generally flat lower portion of said privacy screen.

51. A privacy screen as set forth in claim 50, wherein:

said bowed upper member of said perimeter frame comprises a flexibly resilient member having a normally straight shape that is elastically deformed into an outwardly bowed shape during assembly.

52. A privacy screen as set forth in claim 51, wherein:

said upper portion of said privacy screen is constructed from a single layer of said woven stretch fabric, and has a density which renders the same generally translucent for enhanced light, air and visual porosity.

53. A privacy screen as set forth in claim 52, wherein:

said lower portion of said privacy screen is constructed from at least two layers of said woven stretch fabric, and has a density which renders the same generally opaque for enhanced visual privacy.

54. A privacy screen as set forth in claim 53, wherein:

said fabric sheet includes an upper perimeter pocket in which said upper member of said perimeter frame is received.

55. A privacy screen as set forth in claim 54, wherein:

said fabric sheet is constructed from a single sheet that is folded over said lower member of said perimeter frame to define said at least two layers at the lower portion of said privacy screen.

56. A privacy screen as set forth in claim 55, wherein:

said fabric sheet includes sewn-in rods extending along the opposite sides thereof; and said side members of said perimeter frame include a pair of channels on opposite sides thereof in which said sewn-in rods are inserted and captured.

57. A furniture system as set forth in claim 56, wherein:

said upper member of said perimeter frame is bowed both outwardly and downwardly such that said privacy screen has a top with a concave front elevational shape.

58. In a post and beam furniture system of the type having a plurality of vertical posts with beams connected to upper ends of said posts to spatially partition an open office plan into multiple workstations each having an interior with an opening into an adjacent space, the improvement comprising:

at least one privacy screen shaped to enclose a substantial portion of the opening of an associated one of said workstations, and including a perimeter frame having a panel of woven fabric material mounted thereon; said panel having a front surface with a lower portion thereof extending from adjacent the floor to adjacent worksurface height, and being constructed from at least two layers of said woven fabric material, and having a density which renders the same generally opaque for enhanced visual privacy, and an upper portion thereof extending upwardly from adjacent worksurface height, and being constructed from a single layer of the woven fabric material, with a density which renders the same generally translucent for enhanced light, air and visual porosity.

59. A furniture system as set forth in claim 58, wherein:

said posts include mounting slots extending vertically along at least one side thereof; and including hang-on brackets detachably mounted in said slots, and connected with said perimeter frame to removably mount said privacy screen over said opening.

60. A furniture system as set forth in claim 59, wherein:

said perimeter frame includes a lower member extending horizontally across said opening adjacent a lower portion thereof, a pair of side members extending vertically along opposite sides of said opening, and an upper member extending horizontally across said opening adjacent an upper portion thereof.

61. A furniture system as set forth in claim 60, wherein:

said fabric panel includes a pocket in which said upper member of said perimeter frame is received.

62. A furniture system as set forth in claim 61, wherein:

said fabric panel includes sewn-in rods extending along the opposite sides thereof; and said side members of said perimeter frame include a pair of channels on opposite sides thereof in which said sewn-in rods are inserted and captured.

63. A furniture system as set forth in claim 62, wherein:

said panel of woven fabric material comprises a stretch fabric having a perimeter thereof attached to said perimeter frame in a tensed condition to conform to the shape of said perimeter frame.

64. A furniture system as set forth in claim 63, wherein:

said upper member of said perimeter frame is bowed both outwardly and downwardly such that said privacy screen has a top with a concave front elevational shape.

* * * * *

UNITED STATES PATENT AND TRADEMARK OFFICE

CERTIFICATE OF CORRECTION

PATENT NO. : 6,354,043 B1
DATED : March 12, 2002
INVENTOR(S) : David E. Simon et al.

It is certified that error appears in the above-identified patent and that said Letters Patent is hereby corrected as shown below:

Column 1,
Line 19, "5,899,035" insert -- 5,899,025 --.

Column 2,
Line 17, "detracted" should be -- detracting --.

Column 3,
Line 63, "comer" should be -- corner --.

Column 4,
Line 7, "comer" should be -- corner --.

Column 5,
Lines 17 and 18, "comer" should be -- corner --.

Column 6,
Lines 12, 18 and 22, "comer" should be -- corner --.

Column 10,
Line 52, delete "an exterior surface".
Line 55, after "has" insert -- an exterior surface --.

Signed and Sealed this

Ninth Day of July, 2002

*Attest:*

*Attesting Officer*

JAMES E. ROGAN
*Director of the United States Patent and Trademark Office*